US008459047B2

(12) United States Patent
Hall et al.

(10) Patent No.: US 8,459,047 B2
(45) Date of Patent: Jun. 11, 2013

(54) METHOD AND APPARATUS FOR MAKING CLEAR ICE

(75) Inventors: David L. Hall, Piedmont, SC (US); James Scoville, Sturgeon Bay, WI (US)

(73) Assignee: Electrolux Home Products, Inc., Charlotte, NC (US)

( * ) Notice: Subject to any disclaimer, the term of this patent is extended or adjusted under 35 U.S.C. 154(b) by 177 days.

(21) Appl. No.: 12/902,606

(22) Filed: Oct. 12, 2010

(65) Prior Publication Data

US 2011/0209483 A1 Sep. 1, 2011

Related U.S. Application Data

(63) Continuation of application No. 12/714,044, filed on Feb. 26, 2010, now abandoned.

(60) Provisional application No. 61/156,502, filed on Feb. 28, 2009.

(51) Int. Cl.
*F25C 1/00* (2006.01)

(52) U.S. Cl.
USPC ..... 62/66; 62/340

(58) Field of Classification Search
USPC ..... 62/66, 67, 340, 345, 440, 344, 132, 62/137
See application file for complete search history.

(56) References Cited

U.S. PATENT DOCUMENTS

| | | | | |
|---|---|---|---|---|
| 3,146,606 | A | 9/1964 | Grimes et al. | |
| 3,418,823 | A | 12/1968 | Vivai | |
| 3,580,007 | A * | 5/1971 | Bauerlein | 62/345 |
| 4,184,339 | A | 1/1980 | Wessa | |
| 4,375,757 | A | 3/1983 | Amsdill et al. | |
| 5,187,948 | A | 2/1993 | Frohbieter | |
| 5,297,394 | A | 3/1994 | Frohbieter et al. | |
| 6,112,540 | A * | 9/2000 | Serrels et al. | 62/351 |
| 6,425,259 | B2 * | 7/2002 | Nelson et al. | 62/344 |
| 6,688,130 | B1 | 2/2004 | Kim | |
| 6,688,131 | B1 | 2/2004 | Kim et al. | |
| 6,735,959 | B1 | 5/2004 | Najewicz | |

(Continued)

FOREIGN PATENT DOCUMENTS

| | | |
|---|---|---|
| DE | 10336834 | 3/2005 |
| DE | 102006061090 | 6/2008 |

(Continued)

OTHER PUBLICATIONS

International Search Report for PCT/US2010/025604 dated Nov. 11, 2010, 4 pages.

*Primary Examiner* — Mohammad M Ali
(74) *Attorney, Agent, or Firm* — Pearne & Gordon LLP

(57) ABSTRACT

Provided are a method and refrigeration appliance for making substantially-transparent ice. The refrigeration appliance includes a fresh food compartment in which a refrigeration temperature that is greater than 32° F. and less than 55° F. is maintained, and a water tray disposed within the fresh food compartment and including a bottom surface and an upwardly extending wall forming a reservoir for holding a volume of water. A plurality of fingers are supported adjacent to the water tray to be at least partially submerged in water within the water tray, and an evaporator is in thermal communication with the fingers for chilling an exposed surface of the fingers to a finger temperature that is less than 32° F. Water is introduced into the water tray, and an extent to which the fingers are submerged in the water is repeatedly adjusted.

17 Claims, 6 Drawing Sheets

U.S. PATENT DOCUMENTS

| | | | | |
|---|---|---|---|---|
| 6,742,351 | B2 | 6/2004 | Kim et al. | |
| 6,964,177 | B2 | 11/2005 | Lee et al. | |
| 7,017,354 | B2 | 3/2006 | Lee et al. | |
| 7,216,491 | B2 * | 5/2007 | Cole et al. | 62/74 |
| 2001/0025505 | A1 * | 10/2001 | Nelson et al. | 62/371 |
| 2002/0073728 | A1 | 6/2002 | Stensrud et al. | |
| 2006/0090496 | A1 | 5/2006 | Adamski et al. | |
| 2006/0174646 | A1 * | 8/2006 | Comerci et al. | 62/340 |
| 2006/0242971 | A1 * | 11/2006 | Cole et al. | 62/66 |
| 2007/0163282 | A1 | 7/2007 | Cushman et al. | |
| 2008/0156001 | A1 * | 7/2008 | Lee et al. | 62/74 |

FOREIGN PATENT DOCUMENTS

| | | |
|---|---|---|
| EP | 0364686 | 4/1990 |
| EP | 1416240 | 5/2004 |
| WO | 2008052736 | 5/2008 |
| WO | 2008082217 | 7/2008 |
| WO | 2008095268 | 8/2008 |

* cited by examiner

METHOD AND APPARATUS FOR MAKING CLEAR ICE

This application claims the benefit of U.S. Provisional Patent Application No. 61/156,502 filed on Feb. 28, 2009, the entire disclosure of which is hereby incorporated herein by reference.

BACKGROUND OF THE INVENTION

1. Field of the Invention

The present invention is directed generally to making ice, and more particularly, to a method and apparatus for making clear ice within a fresh-food compartment of a refrigeration appliance, optionally to be dispensed through a door provided to restrict access into said fresh-food compartment.

2. Description of Related Art

Traditionally, making ice includes filling each individual ice mold in an ice tray with water and placing the ice tray in a freezer compartment having an ambient temperature well below 32° F. Once the water is fully frozen, the ice trays are removed from the freezer and each individual cube ejected from its mold into a bin or placed into a fluid medium to be cooled. However, such a batch process of making ice cubes requires manually filling the ice trays each time ice is to be made. Further, the extremely cold temperatures within the freezer compartment cause the ice to freeze more rapidly than air and other gasses trapped within the water can escape, causing the gas to be trapped within the ice, which leads to the ice having an opaque appearance.

More recently, automated ice makers have been disposed within the freezer compartments of refrigeration appliances where the ambient temperature is again much colder than the freezing point of water. The need for manually filling the ice trays is eliminated by the automatic distribution of water into each of the individual ice molds of the ice tray. But again, the rate at which the ice is frozen due to the ambient temperature within the freezer compartment is too fast to allow the gas within the water to escape before it freezes, which causes the ice to have an opaque appearance.

To minimize the opacity of the ice, more gradual methods of freezing water have been developed. Such methods require the cyclical submergence of a freezing finger into each individual ice mold of the ice tray within a freezer compartment in which the ambient temperature is well below the temperature at which water freezes. As the freezing fingers are submerged and removed from the water in the mold for each cube, air bubbles at the surface of each freezing finger follow the finger and float upward and out of the water. With the air bubbles removed, the resulting ice exhibits less opacity. But such methods chill the temperature of the fingers to a temperature much lower than the temperature at which water freezes to expedite freezing. It is typical for conventional freezing methods and devices to require chilling of the fingers to a temperature of −22° C., which corresponds to a temperature of −7.6° F. Such cold finger temperatures again freeze the water in contact with the fingers too quickly to allow the air bubbles to escape, resulting in an opaque region in the center of each cube. Additionally, the ice so created is stored within the freezer compartment with its ambient temperature much lower than the freezing temperature of water, resulting in the formation of an opaque ice film on the exterior surfaces of the ice.

Newer designs of refrigeration appliances have also recently moved the freezer compartment from its conventional location vertically above or laterally to the side of a fresh food compartment. Such conventional locations allowed the ice formed in the freezer compartment to fall under the force of gravity into a dispenser unit that could be accessed externally of the refrigeration appliance. This way, ice could be obtained without having to open the door to the freezer compartment. But with the freezer compartment vertically beneath the fresh food compartment, ice can not fall under the force of gravity into an ice dispenser provided at an accessible location in the door of the refrigeration unit. Moreover, some refrigeration units include only a fresh food compartment, giving consumers the option to utilize a separate large-capacity, stand-alone freezer unit located at a remote location away from the kitchen.

Accordingly, there is a need in the art for a method and apparatus for making substantially-transparent ice that minimizes opacity of the ice resulting from a trapped gas.

BRIEF SUMMARY OF THE INVENTION

According to one aspect, the present invention provides a method of making substantially-transparent ice within a fresh-food compartment of a refrigeration appliance. The method includes adjusting a temperature of an exposed surface of a plurality of fingers to which the ice is to freeze to a finger temperature that is less than or equal to about 32° F., and maintaining a temperature within the fresh-food compartment in which the fingers and a water tray are disposed to an ambient temperature that is greater than or equal to about 32° F. Water is introduced into the water tray disposed within the fresh-food compartment, and at least a portion of the fingers are repeatedly submerged in the water within the water tray and subsequently at least partially removed from the water during formation of the substantially-transparent ice.

According to another aspect, the present invention provides a refrigeration appliance including an ice maker for making substantially-transparent ice. The refrigeration appliance comprises a fresh food compartment in which a refrigeration temperature that is greater than 32° F. and less than 55° F. is maintained. A water tray is disposed within the fresh food compartment and exposed to an ambient environment of the fresh food compartment maintained at the refrigeration temperature. The water tray includes a bottom surface and an upwardly extending wall forming a reservoir for holding a volume of water, and a plurality of fingers are supported adjacent to the water tray to be at least partially submerged in water within the water tray. An evaporator is provided in thermal communication with the fingers for chilling an exposed surface of the fingers to a finger temperature that is less than 32° F. A controller controls a depth of water relative to the fingers to repeatedly submerge at least a portion of the fingers in the water and subsequently remove the fingers from the water to build substantially-transparent ice on an exposed surface of the fingers.

According to another aspect, the present invention provides a refrigeration appliance including an ice maker for making substantially-transparent ice. The refrigeration appliance comprises a fresh food compartment in which a refrigeration temperature greater than or equal to 32° F. and less than 55° F. is maintained. A water tray is disposed within the fresh food compartment and includes a bottom surface and an upwardly extending wall forming a reservoir for holding a volume of water. A plurality of fingers are supported within the fresh food compartment adjacent to the water tray to be at least partially submerged in water within the water tray. An evaporator in thermal communication with the fingers chills an exposed surface of the fingers to a finger temperature within a range of about 28° F. to about 32° F., and a second evaporator in thermal communication with the fresh food compartment maintains the refrigeration temperature therein. The second evaporator is operable independent of the evaporator in thermal communication with the fingers, and a compressor introduces a refrigerant to both the evaporator in thermal communication with the fingers and the second evaporator. A defroster is provided in thermal communication to at least partially melt a portion of the ice in direct contact with the fingers for separating the ice from the fingers. During ice formation, a depth to which the fingers are submerged in the water within the water tray is repeatedly adjusted to form substantially-transparent ice.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION OF ILLUSTRATIVE EMBODIMENTS

Figure 1:
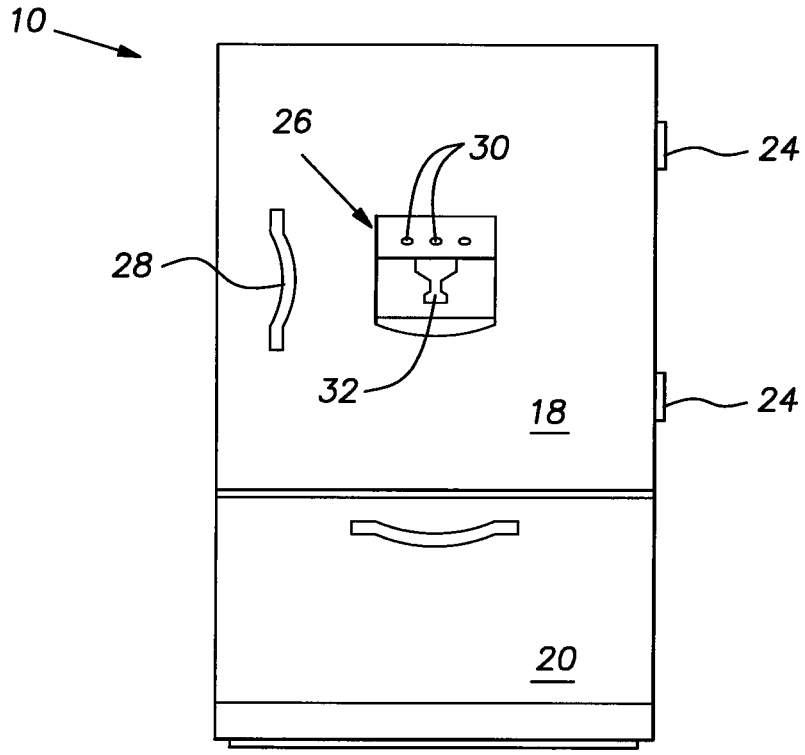
FIG. 1 is a front view of an illustrative embodiment of a refrigeration appliance.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

Figure 2:
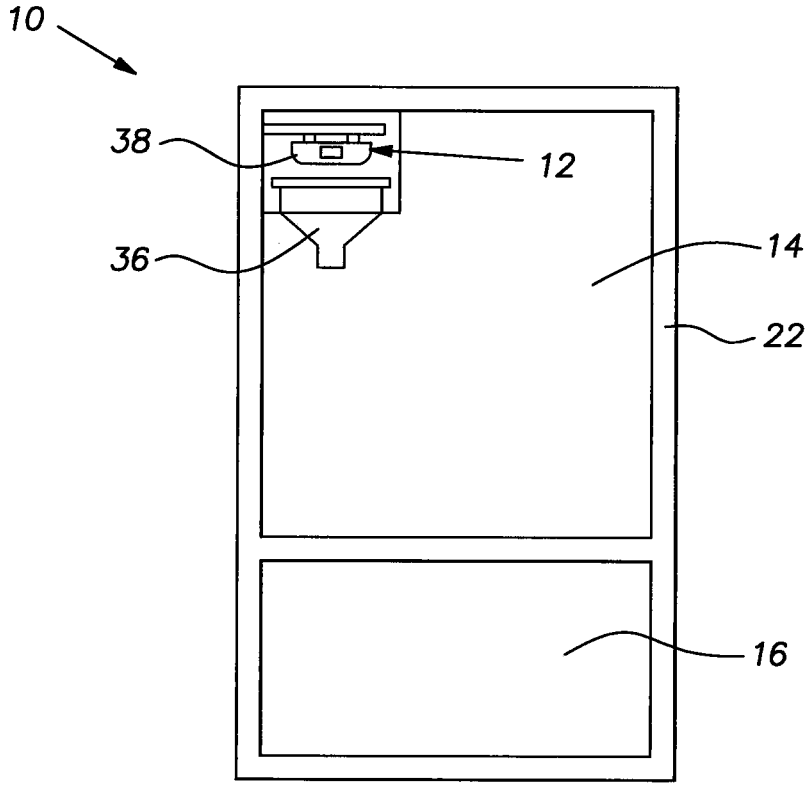
FIG. 2 is a front view of an interior of a fresh food compartment and a freezer compartment of a refrigeration appliance, wherein a fresh food door and a freezer door have been removed to expose said compartments.

An embodiment of a refrigeration appliance 10 including an ice maker 12 for making substantially-transparent ice in a fresh food compartment 14 is shown in FIGS. 1 and 2. As shown, the refrigeration appliance 10 is divided into a fresh food compartment 14 and a freezer compartment 16, which is located vertically beneath the fresh food compartment 14. A fresh food door 18 and a freezer door 20 are provided to allow access to the fresh food compartment 14 and freezer compartment 16, respectively. The fresh food door 18 is pivotally connected to a frame structure 22 by a plurality of hinges 24, while the freezer door 20 slides outwardly as part of a drawer assembly (not shown) to permit access to the freezer compartment 16.

A water/ice dispenser 26 can optionally be exposed to an external environment of the refrigeration appliance 10 to dispense water, ice, or both water and ice without requiring access to an interior of the fresh food compartment 14 or the freezer compartment 16 through an open door 18, 20. For the embodiment shown in FIG. 1, the water/ice dispenser 26 is installed into the fresh food door 18 adjacent to a handle 28, with an actuation lever 32 recessed into the fresh food door 18. When ice and/or water is desired, a drinking glass can be pressed against the lever 32 to actuate the dispenser 26, thereby causing ice and/or water to be dispensed from the refrigeration appliance 10 into the drinking glass without requiring either the fresh food door 18 or the freezer door 20 to be opened. Instead, ice, for example, passes from a bin 34 and through an optional hopper portion 36 that is in communication with an aperture (not shown) formed in an interior surface of the fresh food door 18 while the door is shut. The ice can travel through an interior passage from the aperture on the inside of the fresh food door 18 to the dispenser 26, from where it will enter the drinking glass. Selecting between water and ice can be accomplished by pushing the appropriate menu button(s) 30 corresponding to the item desired to be dispensed by the water/ice dispenser 26.

The fresh food compartment 14 is also commonly referred to as a refrigerator, and has an ambient temperature therein maintained within a range of temperatures from about 32° F. to about 55° F., including all sub-ranges within said range. Thus, the ambient temperature within the fresh food compartment 14 is less than the room temperature of a typical kitchen, but greater than the temperature at which water freezes, which is about 32° F. at sea level. The freezer compartment 16, on the other hand, has an ambient temperature therein maintained at a temperature that is less than 30° F., and more appropriately within a range of temperatures from about −15° F. to about 15° F., including all sub-ranges within said range.

The arrangement shown in FIGS. 1 and 2 is merely for illustrative purposes, and it is understood that the refrigeration appliance 10 of the present invention can include only a fresh food compartment 14 without the freezer compartment 16. Further, the freezer compartment 16, if included, can be situated in any desired position and orientation relative to the fresh food compartment 14, and the water/ice dispenser 26 is optional.

Figure 3:
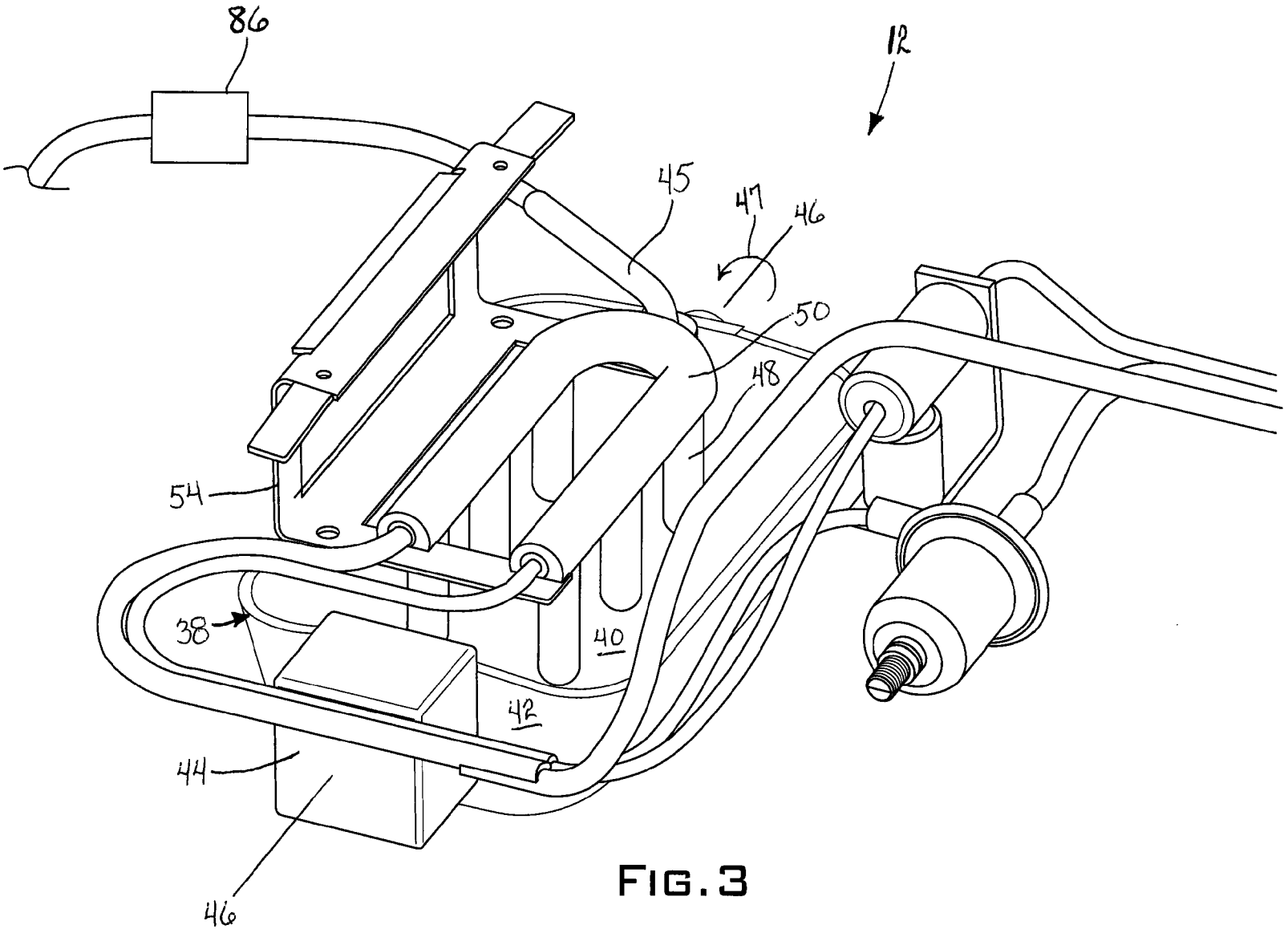
FIG. 3 is a perspective view of an ice maker for making substantially-transparent ice.

FIG. 3 is a perspective view of an ice maker 12 for making substantially-transparent ice in accordance with an embodiment of the present invention. The ice maker 12, as shown in FIG. 2, is disposed at least partially within the fresh food compartment 14 of the refrigeration appliance 10. The ice maker includes a water tray 38 disposed within the fresh food compartment 14 and comprising a bottom surface 40 and an upwardly extending wall 42 forming a reservoir for holding a volume of water. The interior of the reservoir for holding the water, and any water held therein are exposed to the ambient environment of the fresh-food compartment 14 in which the refrigeration temperature of greater than 32° F. and less than 55° F. is maintained. The water tray 38 can be made from any suitable material that can withstand the temperatures within the fresh food compartment 14, such as a light-weight plastic material for example. Further, the water tray 38 can optionally include a plurality of individual ice molds (not shown) separated by a network of dividing members (not shown) to form a plurality of separate ice cubes, each from its own reservoir. Alternate embodiments such as that shown in FIG. 3, however, include a water tray 38 formed as a single reservoir to hold a single volume of water that is not subdivided into separate pools. For such embodiments, each ice cube is formed from the same body of water, water which can be introduced to the water tray 38 through a hose 45 in fluid communication with a water supply such as a household water line through which water from a public utility flows, a private or public well, an on-board fresh water reservoir provided to the refrigeration appliance 10, and the like. An electric motor 44 or other drive mechanism is operatively coupled to the water tray 38 to pivot the water tray 38 about axis of rotation 46-46 in the direction of arrow 47.

A plurality of fingers 48 are also supported within the fresh food compartment 14 adjacent to the water tray 38 to be at least partially submerged in water within the water tray 38 when it is desired to make substantially-transparent ice. Each finger 48 can include a generally cylindrical metal housing suspended from a frame 50, which can also be formed from a metal or other suitable conductor of thermal energy. The frame 50 defines a generally cylindrical interior passage through which a refrigerant can travel to remove thermal energy from the frame 50, and accordingly, the fingers 48. The frame 50 and fingers 48 are in fluid communication with an ice maker refrigeration circuit 52, shown in, and discussed in detail with regard to FIG. 4 below. A bracket 54 along with mechanical fasteners, an adhesive, or other suitable fastener is provided to couple the ice maker 12 to the refrigeration appliance 10 within the fresh food compartment 14.

Figure 4:
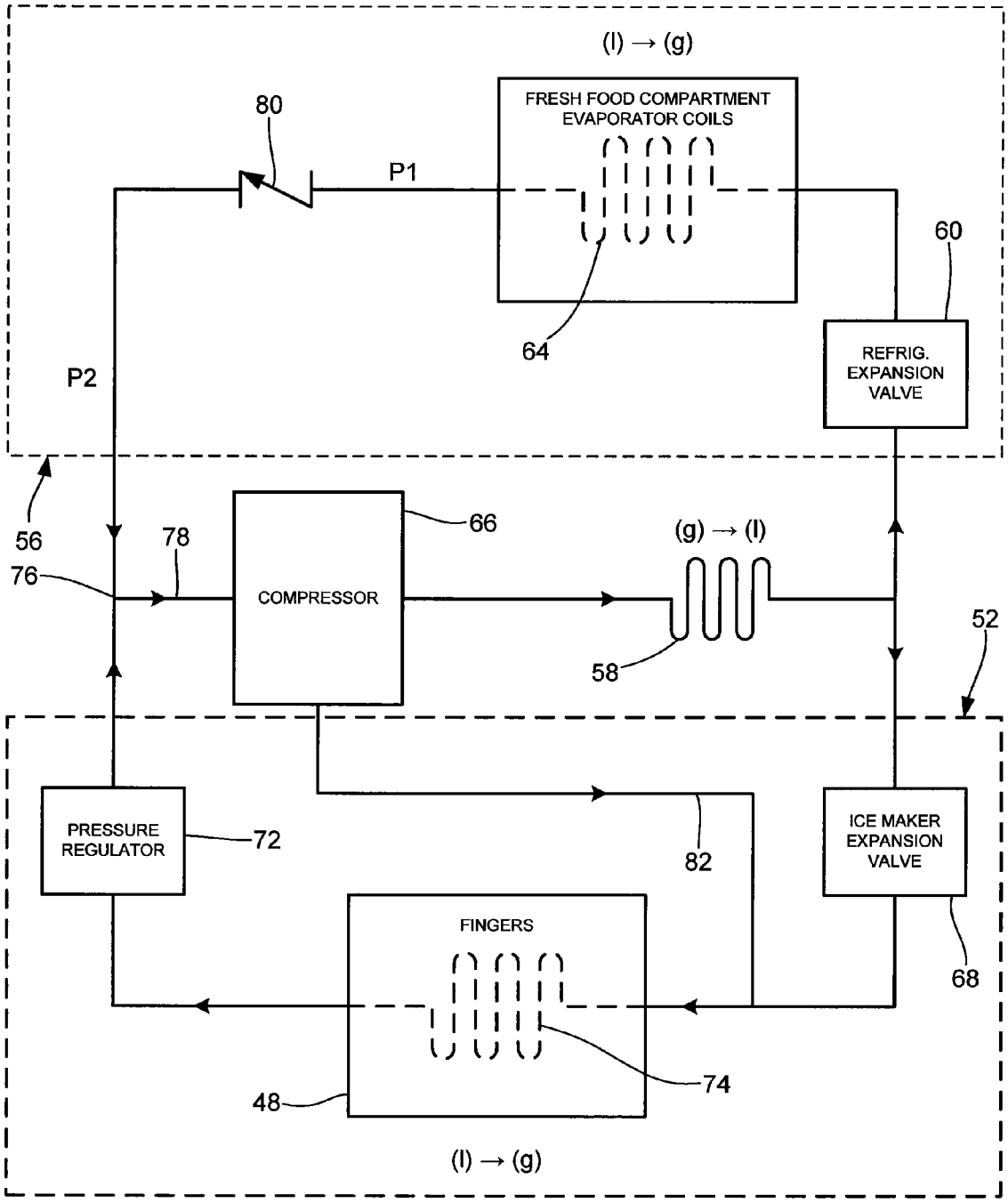
FIG. 4 is a block diagram illustrating an embodiment of refrigeration circuits for controlling temperatures of a refrigeration apparatus.

The refrigeration circuits for removing thermal energy from environments to be chilled will be described with reference to FIGS. 3 and 4. FIG. 4 is a block diagram illustrating said refrigeration circuits through which the refrigerant travels in various phases to remove thermal energy from a first environment to be chilled and discharge thermal energy into a second, ambient environment of the refrigeration appliance 10. The temperature within the fresh food compartment 14 is maintained by the fresh food refrigeration circuit 56, while the temperature of the fingers 48 is established by the ice maker refrigeration circuit 52.

The fresh food refrigeration circuit 56 includes a condenser 58 in which the refrigerant undergoes a state change by cooling from a high pressure, high temperature gas to a liquid with a temperature that is lower than the high-temperature gas. An embodiment of the condenser 58 includes a segment of metal tubing bent into a network of coils in thermal communication with fins to maximize the surface area for transferring thermal energy to an ambient environment of the condenser 58. As the refrigerant condenses it releases thermal energy, including latent heat of condensation due to the state change, that is discharged as heat into the ambient environment of the refrigeration appliance 10 through the condenser 58.

Once the refrigerant has condensed in the condenser 58, the liquid refrigerant remains at a relatively high pressure before entering an expansion valve 60, which can alternately be a capillary tube or other expansion conduit, which is in fluid communication with the condenser 58. The expansion valve 60 is a valve that meters the flow of high-pressure liquid refrigerant flowing from the condenser 58 to a low-pressure environment within fresh food compartment evaporator coils 64 discussed below. It also contributes to the pressure drop between the condenser 58 and fresh food compartment evaporator coils 64, substantially isolating those two environments from each other.

As the refrigerant flows through the expansion valve 60 it enters the fresh food compartment evaporator coils 64, which are provided with fins to maximize surface area for heat transfer and are disposed within the freezer compartment 16. Air chilled by the evaporator coils 64 is blown into the fresh-food compartment 14 through passages extending between the fresh-food and freezer compartments 14, 16 to remove thermal energy from the fresh-food compartment 14. The pressure of the refrigerant within the fresh food compartment evaporator coils 64 is lower than the pressure of the refrigerant in the condenser 58. Like the condenser 58, the fresh food compartment evaporator coils 64 can include a metallic tube, a section of which being bent into a network that maximizes the surface area available for heat transfer to take place. Experiencing such a change in pressure upon entering the fresh food compartment evaporator coils 64, the liquid refrigerant rapidly evaporates back into a substantially gaseous phase. In order for this to occur, however, the refrigerant must draw a significant amount of thermal energy, including the latent heat of vaporization, from an ambient environment of the evaporator coils 64. This ambient environment of the evaporator coils 64 in the present example is the freezer compartment 16 of the refrigeration appliance 10. Cold air from the freezer compartment 16 can selectively be blown into the fresh-food compartment by a fan or other air mover (not shown) to maintain the temperature in the fresh-food compartment within the desired range of acceptable temperatures. Blowing the chilled air into the fresh food compartment 14 causes the temperature within the fresh food compartment 14 to drop, thereby chilling that compartment to a temperature below about 55° F., but above the freezing temperature of water.

A compressor 66 is provided to the refrigeration appliance 10 in fluid communication with the fresh food compartment evaporator coils 64 for establishing a vacuum at an outlet of the fresh food compartment evaporator coils 64. This vacuum sucks the evaporated refrigerant from the fresh food compartment evaporator coils 64, thereby maintaining the low pressure downstream of the expansion valve 60 relative to upstream of the expansion valve 60 within the condenser 58. The compressor 66 compresses the gaseous refrigerant discharged from the fresh food compartment evaporator coils 64 to a pressure that is higher than the pressure of the refrigerant input to the compressor 66, which also causes the temperature of the refrigerant to increase. The high-pressure, high-temperature refrigerant is then again re-introduced to the condenser 58 and the cycle is repeated as necessary to maintain the temperature within the freezer compartment 16 and the fresh food compartment 14.

The ice maker refrigeration circuit 52 operates similar to the fresh food refrigeration circuit 56 in theory. High-pressure, high-temperature gaseous refrigerant from the compressor 66 is condensed within the condenser 58, which can optionally be the same condenser 58 shared with the fresh food refrigeration circuit 56, as shown in FIG. 4. Other embodiments of the ice maker refrigeration circuit 52 include a condenser 58 that is independent of the condenser 58 provided to the fresh food refrigeration circuit 56. The liquid refrigerant flows through an ice maker expansion valve 68, entering the low pressure environment within ice maker evaporator coils 74, which can also include a metallic conduit having at least a portion thereof arranged in a network to maximize surface area available for heat transfer to occur. The ice maker evaporator coils 74 are in thermal communication with the fingers 48 to chill an exposed surface of the fingers 48 to a finger temperature within the range of about 28° F. to about 32° F.

The ice maker refrigeration circuit 52 also includes a pressure regulator 72 such as a rolling diaphragm air cylinder, electropneumatic transducer, and the like, downstream of the ice maker evaporator coils 74 but before (i.e., upstream of) the compressor 66 in the ice maker refrigeration circuit 52 to control the pressure therein, which in turn controls the finger temperature. References herein to "upstream" and "downstream" are best understood relative to the various components within the refrigeration circuits 52, 56. A component in the refrigeration circuits 52, 56 after the compressor 66 through which the refrigeration travels before reaching a subsequent component is said to be "upstream" of that subsequent component. For example, the ice maker expansion valve 68 is upstream of the pressure regulator 72 because when considering the compressor 66 as the beginning of the ice maker refrigeration circuit 52, the refrigerant flows through the ice maker expansion valve 68 before reaching the pressure regulator 72 under normal operating conditions.

The pressure regulator 72 is operable to selectively minimize the effect of the vacuum created at the input of the compressor 66, while operating, on the pressure at the outlet of the ice maker evaporator coils 74. The low-pressure intake line 78 leading into the compressor 66 can optionally be shared by the fresh food refrigeration circuit 56 and the ice maker refrigeration circuit 52 to return evaporated gaseous refrigerant from both refrigeration circuits 52, 56 to the compressor 66. As shown in FIG. 4, the gaseous refrigerant from both refrigeration circuits 52, 56 can be combined at a common connection point 76 upstream from the compressor 66 before being returned to the compressor 66. Although the compressor 66 can be common to deliver refrigerant to both the ice maker refrigeration circuit 52 and the fresh food refrigeration circuit 56, refrigerant can optionally be delivered to chill the fresh food compartment evaporator coils 64 independent of the ice maker evaporator coils 74 in thermal communication with the fingers 48.

Once the substantially-transparent ice has formed on the fingers 48 as described in detail below, the ice must be removed in order to be easily extracted from the bin 34. The temperature of the exposed surface of the fingers 48 is temporarily elevated to a finger temperature above the freezing point of water, or above 32° F. This melts at least a portion of the ice in contact with the exposed surface of the fingers 48, allowing the ice to fall from the fingers 48 under the force of gravity into the bin 34, which is disposed vertically beneath the water tray 38. Any remaining water in the water tray 38 is drained, and the water tray 38 is pivoted about axis 46-46 when the ice is to be removed from the fingers 48 to allow the falling ice from the fingers 48 to reach the bin 34.

According to one embodiment, the exposed surface of the fingers 48 is elevated enough to melt the ice in contact with the fingers 48 through operation of the pressure regulator 72. The pressure regulator 72 is operable to close, or at least partially restrict the fluid flow path from the ice maker evaporator coils 74 back to the compressor 66. This interference of the fluid flow elevates the pressure within the ice maker evaporator coils 74 above the low pressure required to maintain the temperature of the fingers 48 below 32° F. If the pressure within the ice maker evaporator coils 74 is elevated, the pressure drop across the ice maker expansion valve 68 is less than what it is under normal operating conditions when the finger temperature is maintained below 32° F. When the pressure within the ice maker evaporator coils 74 is so elevated, evaporation of the refrigerant therein is impeded, thereby minimizing the amount of thermal energy withdrawn from the fingers 48 by the refrigerant and causing the temperature of the fingers 48 to rise above 32° F.

For embodiments including the common connection point 76 at which the refrigerant returned from each of the ice maker refrigeration circuit 52 and the fresh food refrigeration circuit 56, adjusting the pressure of the returning refrigerant could potentially affect operation of the fresh food refrigeration circuit 56. To minimize any effect caused by pressure fluctuations caused by operation of the pressure regulator 72, a unidirectional fluid flow limiting device 80 such as a check valve, for example, is provided between the common connection point 76 and the fresh food compartment evaporator coils 64. The unidirectional fluid flow device 80, also referred to herein as a check valve 80, substantially isolates any pressure fluctuations caused by the pressure regulator 72 from the fresh food compartment evaporator coils 64 until such fluctuations are resolved. However, in the absence of any such pressure fluctuations, the check valve 80 passes refrigerant flowing from the fresh food compartment evaporator coils 64 back to the compressor 66 without significant interference.

For the illustrative arrangement of the refrigeration circuits 52, 56 shown in FIG. 4, if the refrigerant pressure P2 from the ice maker refrigeration circuit 52 at the common connection point 76 exceeds a predetermined value that would affect the outlet pressure P1 from the fresh food compartment evaporator coils 64, the unidirectional fluid flow device 80 is engaged to isolate refrigerant pressure P2 from outlet pressure P1. In this way, the outlet pressure P1 is not elevated to the level of the refrigerant pressure P2 during operation of the pressure regulator 72 to elevate the exposed surface of the fingers 48 above 32° F. And while the fresh food compartment evaporator coils 64 can experience minor fluctuations of the output pressure P1 due to operation of the check valve 80, such fluctuations will be temporary, and will be resolved before the temperature within the fresh food compartment 14 rises above 55° F.

To expedite the release of the ice from the fingers 48, compressed refrigerant can be delivered via a bypass conduit 82 from the compressor 66 to the ice maker evaporator coils 74 without entering the ice maker expansion valve 68. In doing so, the refrigerant has not experienced the pressure drop across the ice maker expansion valve 68, and thus, has a temperature that is higher than it would be had it had gone through the ice maker expansion valve 68 before entering the ice maker evaporator coils 74, but in any event higher than 32° F. The compressed refrigerant delivered to the ice maker evaporator coils 74 via the bypass conduit 82 sufficiently elevates the temperature of the exposed surface of the fingers 48 to at least partially melt the ice frozen thereto, allowing the ice to fall under the force of gravity into the bin 34.

Although the bypass conduit 82 bypasses the ice maker expansion valve 68 in FIG. 4, other embodiments include having the refrigerant flow through the ice maker expansion valve 68 to elevate the finger temperature above 32° F. Such embodiments include adjusting the ice maker expansion valve 68 to adjust the pressure drop experienced by the refrigerant flowing through the ice maker expansion valve 68. This minimizes the evaporation of the refrigerant that draws heat from the fingers 48. Yet other embodiments transport hot gases from the compressor 66 through the bypass conduit 82 to at least partially melt the ice frozen to the exposed surface of the fingers 48, allowing the ice to fall under the force of gravity into the bin 34.

Figure 5:
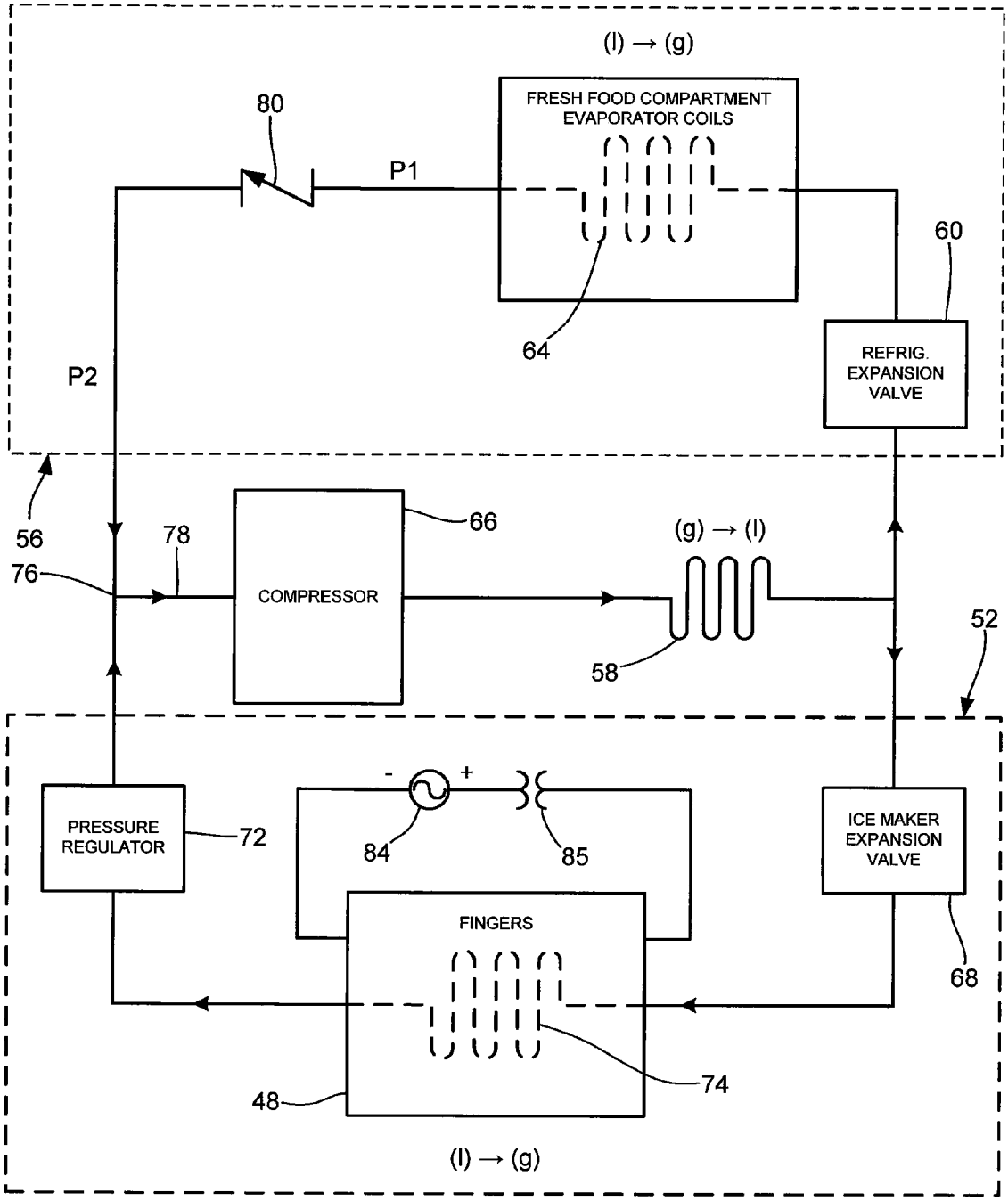
FIG. 5 is a block diagram illustrating another embodiment of refrigeration circuits for controlling temperatures of a refrigeration apparatus.

Yet other embodiments of the present invention, such as that illustrated in FIG. 5, include conducting a low-voltage, low-frequency electrical current through the fingers 48. A source 84 of electric energy can be provided to the refrigeration appliance 10 for delivering a low-frequency AC voltage to the fingers 48. The source 84 can optionally include a step down transformer 85 that modulates the waveform of electric energy from a conventional wall outlet delivering 120 $V_{RMS}$, 60 Hz electric energy. The modulated waveform includes an RMS voltage of less than 120 V that is conducted to the fingers 48. The resistance of the fingers 48 to the flow of electrical current causes at least the exposed surface of the fingers 48 to become heated to a temperature above 32° F., thereby melting at least a portion of the ice in contact with the fingers 48. When a sufficient portion of the ice has melted due to the resistance heating of the fingers 48, the ice falls under the force of gravity into the bin 34.

Referring once again to FIG. 3, the fingers 48 are positioned extending downwardly, generally away from the frame 50 and into the reservoir formed by the water tray 38. Water is to be introduced into the water tray 38 via the hose 45, which is also in fluid communication with a water supply and subsequently drained to submerge and then withdraw portions of the fingers 48 to and from the water in the water tray 38 while the fingers 48 remain stationary. The filling and draining of the water tray 38 is repeated in a cyclical manner to vary the degree to which at least the portions of the fingers 48 to which ice is to freeze are submerged in water within the water tray 38. This cyclical submergence while the finger temperature is no greater than 32° F. as described below gradually forms the substantially-transparent balls of ice on the fingers 48.

According to an embodiment of the refrigeration appliance 10, the repeated submergence of the portions of the fingers 48 is accomplished by controlling operation of a valve, pump 86, which may be a reversible gear pump or any other suitable bi-directional pump 86 in fluid communication with the hose 45, for example, or other suitable device for controlling the flow of water. Operated in a first direction, the pump 86 pumps water from the water supply into the water tray 38, and operated in a second direction opposite the first direction, the pump 86 pumps water from the water tray 38 back to the water supply or to a drain (not shown). The position of the water tray 38 relative to the fingers 48 during formation of the ice is fixed, and the fingers 48 can be stationary as well.

Figure 6:
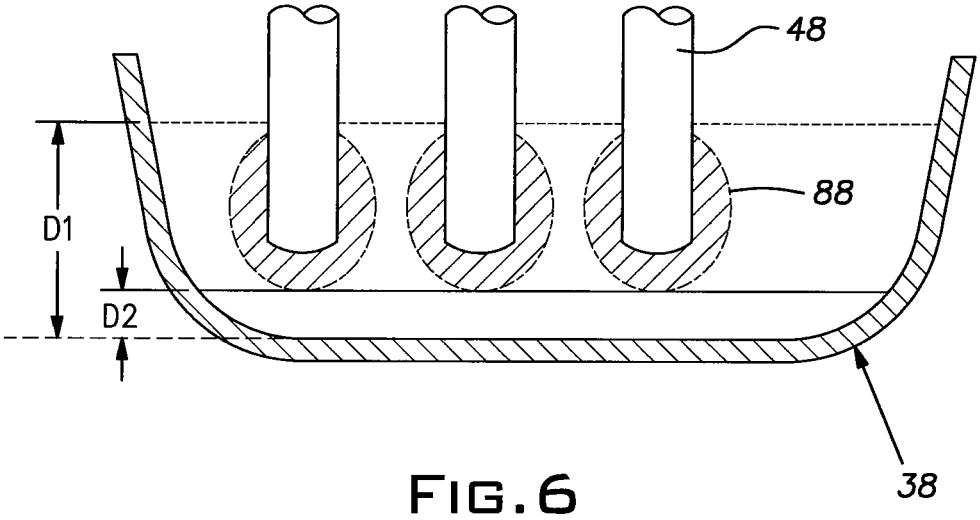
FIG. 6 is a partially cutaway view of the fingers disposed within the water tray to be repeatedly submerged by pumping water into the water tray and removing water from the water tray.

Repeatedly submerging at least the portions of the fingers 48 in the water by varying operation of the pump 86 as described above causes the depth of the water within the water tray 38 to rise above the lowermost portions of the fingers 48, and then recede to a lower level that exposes at least some, and preferably all of the formerly submerged portions of the fingers 48. FIG. 6 is a partially cutaway view of the fingers 48 extending into the water tray 38 to be repeatedly submerged by pumping water into the water tray 38 and removing water from the water tray 38. To submerge at least a portion of the fingers 48, water is pumped into the water tray 38 to establish a deep water depth D1 therein. With the temperature of the exposed surface of the fingers 48 chilled to below 32° F., the water begins to freeze to exposed surfaces of the fingers 48 to form cubes 88, which, due to the lack of individual molds for each cube 88 in FIG. 6, can have a generally spherical shape instead of a cubic shape as the name implies. In fact, the cubes 88 can take on any geometrical shape if individual molds are provided, the depth to which the fingers 48 are submerged is varied, etc. . . . .

After remaining submerged in the water for a predetermined period of time, the pump 86 is operated in the second direction to remove a portion of the water from the water tray 38 in order to establish a shallow water depth D2 therein. With the water at the shallow water depth D2, at least a portion of the fingers 48 and any associated ice frozen thereto are then exposed to the ambient air above the water, said ambient air being maintained at a temperature within the range of about 32° F. to about 55° F. Repeating this submergence and emergence of the fingers 48 results in the gradual formation of ice cubes 88 that are formed in sequential layers built radially outward and that are substantially-transparent.

Alternate embodiments of repeatedly submerging at least a portion of the fingers 48 in the water include repeatedly adjusting the position of at least one of water tray 38 and the set of fingers 48 relative to the other. For example, the frame 50 supporting the fingers 48 or the water tray 38 could be operatively coupled to an electric motor (not shown) for repeatedly adjusting the position of the fingers 48 relative to water within the water tray 38, and then back again.

Figure 7:
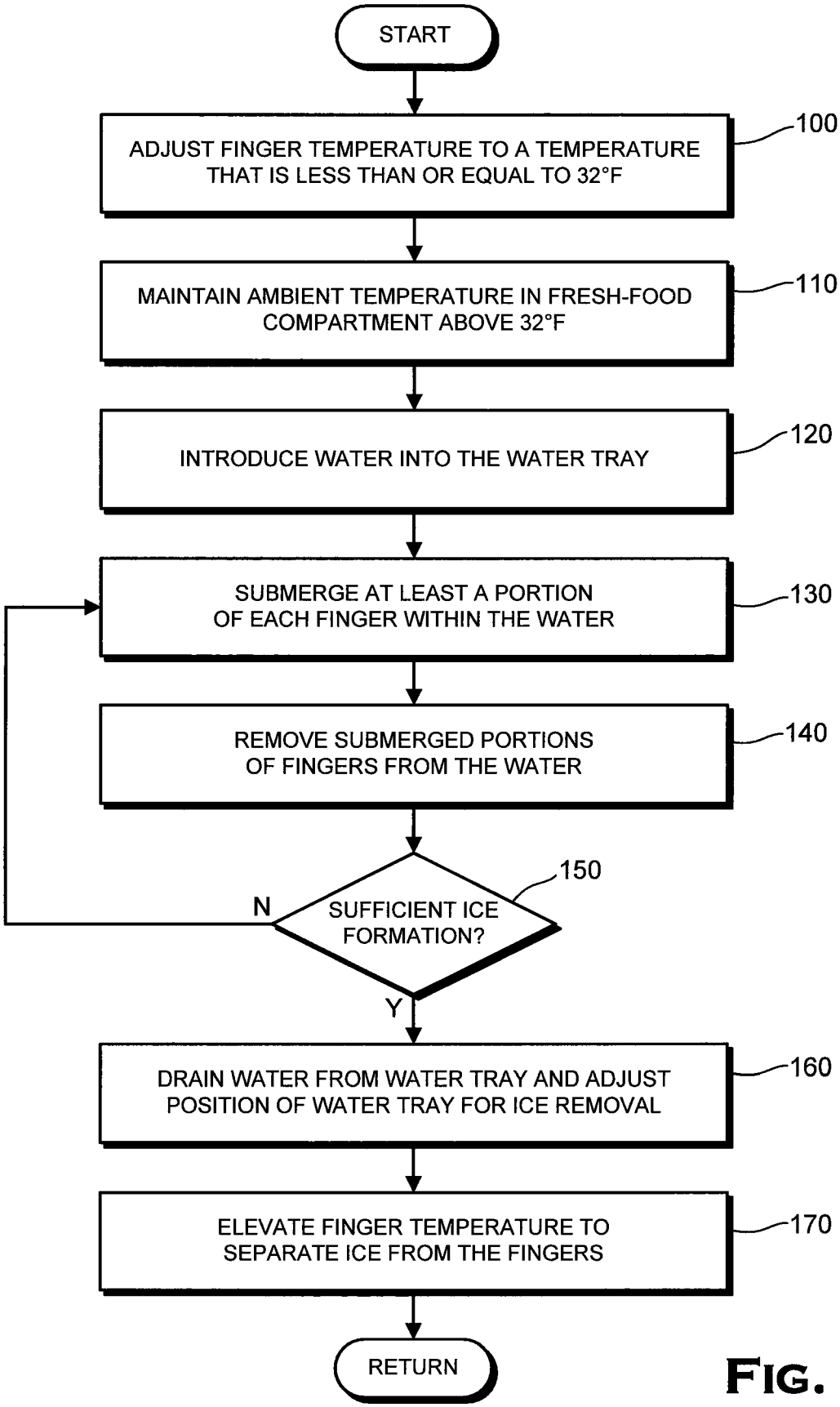
FIG. 7 is a flow diagram illustrating a method of making substantially-transparent ice according to an embodiment of the present invention.

A method of making substantially-transparent ice within a fresh-food compartment 14 of a refrigeration appliance will be described with reference to the flow diagram shown in FIG. 7. The method includes adjusting a temperature of an exposed surface of a plurality of fingers 48 to which the ice is to freeze to a finger temperature that is less than or equal to about 32° F. at step 100, and according to embodiments of the invention, between 28° F. and 32° F. This can be accomplished by energizing the compressor 66 in the ice maker refrigeration circuit 52, opening the expansion valve 68, regulating the pressure within the ice maker evaporator coils 74, or any combination thereof to allow the refrigerant to evaporate in the ice maker coils 74. Although the finger temperature falls to a temperature that is less than or equal to 32° F., the ambient temperature in the fresh-food compartment in which the ice maker 12 is disposed is maintained above 32° F. at step 110, and according to embodiment of the invention, between about 32° F. to about 55° F.

Water is introduced into the water tray 38 within the fresh-food compartment 14 to establish a water depth within the tray 38 at step 120. The water introduced to the water tray 38 can have a temperature that is greater than 40° F., and optionally greater than or equal to about 50° F. to permit gases to escape the water before that water freezes to the fingers 48. At least a portion of each finger 48 is submerged within the water at step 130. The submergence of the portion of each finger 48 can be accomplished by adding water to the water tray 38 until the water depth encompasses the portions of the fingers 48, raising and lowering the water tray 38 holding a fixed amount of water relative to stationary fingers 48, or any other suitable method.

After being at least partially submerged, the submerged portions of the fingers 48 are removed from the water at step 140. Removing the fingers 48 from the water can be accomplished by performing the complement to the step that was performed to submerge the portion of each finger 48. For example, if water was added to the stationary tray 38 until the portions of the fingers 48 were submerged, then the water can be drained until the fingers are removed from the water.

At step 150 it is determined whether there has been a desired amount of ice formation on the submerged portions of the fingers 48. If so, the water is removed from the water tray 38 and the water tray 38 is pivoted about axis 46-46 to allow ice falling from the fingers 48 to land in the bin 34 at step 160. The finger temperature is elevated at step 170 by adjusting the pressure within the ice maker evaporator coils 74, transporting a hot gas to the fingers 48, resistively heating the fingers 48, or any other suitable method, and the ice in direct contact with the exposed surface of the fingers 48 is at least partially melted. When this ice is melted the cubes 88 can fall into the bin 34.

If, however, at step 150 it is determined that there has not yet been a desired amount of ice formation on the fingers, then the process repeats the submergence of the portions of the fingers 48 in the water at step 130. This process is repeated until a desired amount of ice is formed on the fingers 48. The desired amount of ice can be detected based on the weight of the ice cubes 88 frozen to the fingers 48, based on the amount of time that the cubes 88 were allowed to freeze, based on a number of times the fingers were repeatedly submerged in the water, based on a sensed temperature of the fingers 48, or any other suitable way of determining an amount of ice that has formed on the fingers 48.

Illustrative embodiments have been described, hereinabove. It will be apparent to those skilled in the art that the above devices and methods may incorporate changes and modifications without departing from the general scope of this invention. It is intended to include all such modifications and alterations within the scope of the present invention.

What is claimed is:

1. A method of making substantially-transparent ice within a fresh-food compartment of a refrigeration appliance, the method comprising the steps of:

adjusting a temperature of an exposed surface of a plurality of fingers where the ice is to freeze to a finger temperature less than or equal to about 32° F.;

maintaining a temperature within the fresh-food compartment where the fingers and a water tray are disposed to an ambient temperature greater than or equal to about 32° F., wherein the water tray is a single reservoir;

introducing a single volume of water into the single reservoir of the water tray disposed within the fresh-food compartment; and repeatedly submerging at least a portion of the fingers in the single volume of water within the water tray and at least partially removing the fingers and any associated ice from the single volume of water within the water tray during formation of the substantially-transparent ice, wherein the step of repeatedly submerging at least a portion of the fingers comprises the steps of:

pumping a suitable amount of water into the water tray such that the single volume of water establishes a water depth within the tray sufficient to submerge the portion of the fingers; and draining a suitable amount of water from the water tray to expose at least a portion of the fingers and any associated ice previously submerged.

2. The method according to claim 1 further comprising the step of maintaining the finger temperature greater than approximately 28° F.

3. The method according to claim 1, wherein the step of establishing the finger temperature comprises the step of regulating a pressure within an evaporator in thermal communication with the fingers.

4. The method according to claim 1 further comprising the steps of: elevating the finger temperature to at least 32° F. to at least partially melt the ice in contact with the fingers and an allow the ice to separate from the fingers under a gravitational force; and collecting ice separated from the fingers in a bin where an ambient temperature greater than or equal to 30° F. is maintained.

5. The method according to claim 1, wherein the water introduced to the water tray has a temperature greater than or equal to 50° F.

6. A refrigeration appliance including an ice maker for making substantially-transparent ice comprising:

a fresh food compartment where a refrigeration temperature greater than 32° F. and less than 55° F. is maintained;

a water tray disposed within the fresh food compartment and exposed to an ambient environment of the fresh food compartment maintained at the refrigeration temperature, the water tray comprising a bottom surface and an upwardly extending wall forming a single reservoir for holding a single volume of water;

a plurality of fingers supported adjacent to the water tray to be at least partially submerged in single volume of water within the water tray;

an evaporator in thermal communication with the fingers for chilling an exposed surface of the fingers to a finger temperature less than 32° F.;

a second evaporator in thermal communication with the fresh food compartment for maintaining the temperature between 32° F. and 55° F., wherein the second evaporator operates independent of the evaporator in thermal communication with the fingers;

a unidirectional fluid-flow device to substantially isolate pressure fluctuations controlled by a pressure regulator from affecting a pressure within the second evaporator; and a controller for controlling a depth of the single volume of water relative to the fingers to repeatedly submerge at least a portion of the fingers in the single volume of water and subsequently remove the fingers from the single volume of water to build substantially-transparent ice on an exposed surface of the fingers.

7. The refrigeration appliance according to claim 6 further comprising a compressor for elevating a pressure of a refrigerant introduced to both the evaporator in thermal communication with the fingers and the second evaporator in thermal communication with a freezer compartment.

8. The refrigeration appliance according to claim 7 further comprising a pressure regulator for controlling a pressure within the evaporator in thermal communication with the fingers to elevate the finger temperature above 32° F. for separating the ice from the fingers.

9. The refrigeration appliance according to claim 7 wherein refrigerant discharged from the evaporator in thermal communication with the fingers is combined with refrigerant discharged from the second evaporator prior to returning to the compressor.

10. The refrigeration appliance according to claim 6 further comprising a freezer compartment where a temperature is maintained below 32° F.

11. The refrigeration appliance according to claim 10, wherein the freezer compartment is disposed vertically beneath the refrigeration compartment.

12. A refrigeration appliance including an ice maker for making substantially-transparent ice comprising:

a fresh food compartment where a refrigeration temperature greater than or equal to 32° F. and less than 55° F. is maintained;

a water tray disposed within the fresh food compartment and comprising a bottom surface and an upwardly extending wall forming a single reservoir for holding a single volume of water;

a plurality of fingers supported within the fresh food compartment adjacent to the water tray to be at least partially submerged in the single volume of water within the water tray;

an evaporator in thermal communication with the fingers for chilling an exposed surface of the fingers to a finger temperature within a range of about 28° F. to about 32° F.;

a second evaporator in thermal communication with the fresh food compartment to maintain the refrigeration temperature therein, wherein the second evaporator is operable independent of the evaporator in thermal communication with the fingers;

a compressor for introducing a refrigerant to both the evaporator in thermal communication with the fingers and the second evaporator;

a unidirectional fluid-flow device to substantially isolate pressure fluctuations controlled by the pressure regulator from affecting a pressure within the second evaporator;

means for separating the ice from the fingers; and means for repeatedly adjusting a depth the fingers are submerged in the single volume of water within the water tray during formation of the substantially-transparent ice.

13. The refrigeration appliance according to claim 12, wherein the means for repeatedly adjusting the depth the fingers are submerged comprises a reversible pump configured to introduce water into the water tray operating in a first direction and draws water from the water tray operating in a second direction.

14. The refrigeration appliance according to claim 12, wherein the means for repeatedly adjusting the depth the fingers are submerged comprises a motor for repeatedly adjusting the distance separating the water tray from the fingers.

15. The refrigeration appliance according to claim 12 further comprising a pressure regulator for controlling a pressure within the evaporator in thermal communication with the fingers for elevating the finger temperature to melt at least a portion of the ice and separate the ice from the fingers under a gravitational force.

16. The refrigeration appliance according to claim 15 wherein refrigerant discharged from the evaporator in thermal communication with the fingers is combined with refrigerant discharged from the second evaporator prior to returning to the compressor.

17. The refrigeration appliance according to claim 12, wherein the means for separating the ice from the fingers comprises a conduit in thermal communication with the fingers carrying a fluid with a temperature greater than 32° F. discharged from the compressor.

* * * * *